United States Patent [19]

Lane

[11] Patent Number: 4,548,137

[45] Date of Patent: Oct. 22, 1985

[54] WIND CAP

[76] Inventor: Byron D. Lane, P.O. Box 257, Sawyer, N. Dak. 58781

[21] Appl. No.: 708,549

[22] Filed: Mar. 5, 1985

[51] Int. Cl.[4] ..... F23L 17/12

[52] U.S. Cl. ..... 110/184; 98/82; 98/66.1; 98/67; 98/60; 110/322

[58] Field of Search ..... 110/184, 322, 326; 98/42 R, 46, 83, 58–60, 66 R, 67, 82

[56] References Cited

U.S. PATENT DOCUMENTS

| | | | |
|---|---|---|---|
| 2,660,106 | 11/1953 | Gray | 98/83 |
| 2,976,796 | 3/1961 | Anthony et al. | 98/67 |
| 3,361,051 | 1/1968 | Fair et al. | 98/58 |
| 3,855,910 | 12/1974 | Brinton et al. | 98/83 |
| 4,466,340 | 8/1984 | Briner | 98/60 |

*Primary Examiner*—Henry C. Yuen
*Attorney, Agent, or Firm*—Harvey B. Jacobson

[57] ABSTRACT

An upstanding nipple is provided for downward telescoping over the upper end of a furnace flue pipe outlet end and the upper end of the nipple is secured through a central opening formed in a circular base plate over which a circular top plate is supported in vertically spaced relation by a cylindrical spacing member extending between and secured to the outer peripheral portions of the base and top plates. The spacing member includes diametrically opposite openings formed therein covered by screen panel portions and upwardly convergent baffle plates are disposed between the base and top panels with the lower marginal edges of the baffle plates anchored relative to the base plate and the upper marginal edges of the baffle plates terminating upwardly a spaced distance below the top plate and being spaced apart a distance generally equal to one-half the diameter of the nipple. An elliptical tubular shield is provided and telescoped over the spacing member with the major diameter defining portions of the shield spaced outwardly of the diametrically opposite openings formed in the spacing member. The major diameter defining portions of the shield are secured directly to the opposing diametrically opposite portions of the spacing member and the length of the tubular elliptical shield is substantially equal to the spacing between the base and top panels.

7 Claims, 4 Drawing Figures

WIND CAP

BACKGROUND OF THE INVENTION

1. Field of the Invention

This invention relates to an outlet cap for the upper end of a furnace flue pipe and the cap is constructed in a manner to allow substantially unrestricted passage of furnace gases therethrough while at the same time preventing downdrafts in the associated flue pipe as a result of wind incident upon the upper end of the flue pipe.

2. Description of Related Art

Various different forms of caps heretofore have been provided for use on the upper outlet end of furnace flue pipes. These caps are constructed in a manner to prevent foreign objects from falling down into the flue pipe and also to prevent blockage of the upper end of the flue pipe by accumulated snow and/or ice forming as a result of condensation during extremely cold weather. However, high efficiency furnaces utilizing propane as fuel are designed to include a lock-out switch and if high winds are incident upon the upper end of a furnace flue pipe the lock-out switch senses the windy conditions and the resultant downdraft in the flue pipe and terminates operation of the associated furnace. The wind cap of the instant invention is designed to prevent winds incident upon the upper outlet end of an associated flue pipe from causing downdrafts within the pipe and the lock-out switch of an associated furnace to terminate operation of the furnace.

SUMMARY OF THE INVENTION

The wind cap of the instant invention is constructed in a manner whereby furnace exhaust gases may readily pass upwardly therethrough, but also in a manner to prevent high winds incident upon the cap and the associated furnace flue pipe upper end from causing downdrafts within the flue pipe.

The main object of this invention is to provide an apparatus for the outlet end of a furnace flue pipe that will be effective in preventing the formation of downdrafts within the flue pipe as a result of high winds incident upon the flue pipe outlet end.

Another object of this invention is to provide a wind cap in accordance with the preceding object and constructed in a manner whereby furnace flue gases rising through an associated furnace flue pipe may readily pass through the cap for discharging in the ambient air.

Still another important object of this invention is to provide a wind cap constructed in a manner whereby the formation of ice thereon and about the outlet end of the associated flue pipe as a result of condensation during extremely cold weather will be greatly reduced.

Another important object of this invention is to provide a wind cap including structural features which will enable the cap to be utilized in conjunction with furnace flue pipe outlet ends of different sizes.

A final object of this invention to be specifically enumerated herein is to provide a furnace flue pipe wind cap in accordance with the preceding objects and which will conform to conventional forms of manufacture, be of simple construction and easy to install so as to provide a device that will be economically feasible, long lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
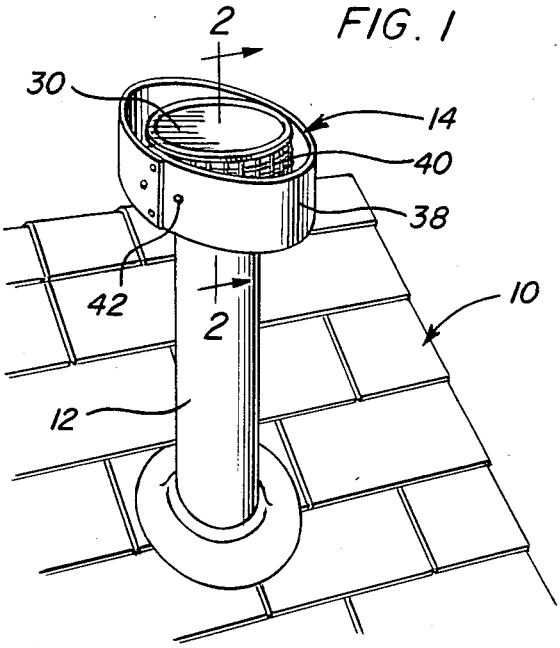
FIG. 1 is a perspective view of the upper outlet end of a furnace pipe projecting above an associated roof and with the wind cap of the instant invention operatively mounted on the upper end of the flue pipe.
Figure 4:
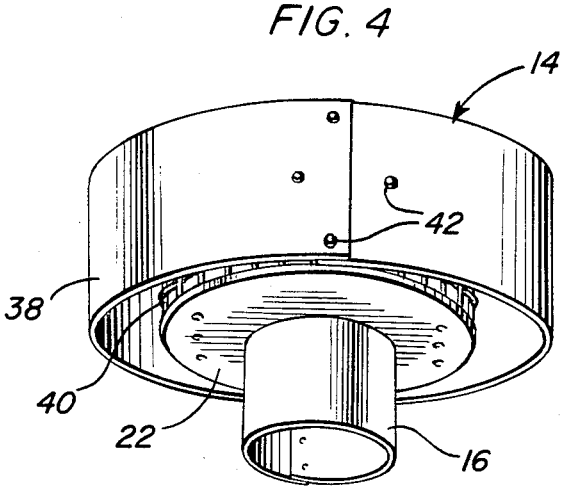
FIG. 4 is a perspective view of the wind cap.
Figure 2:
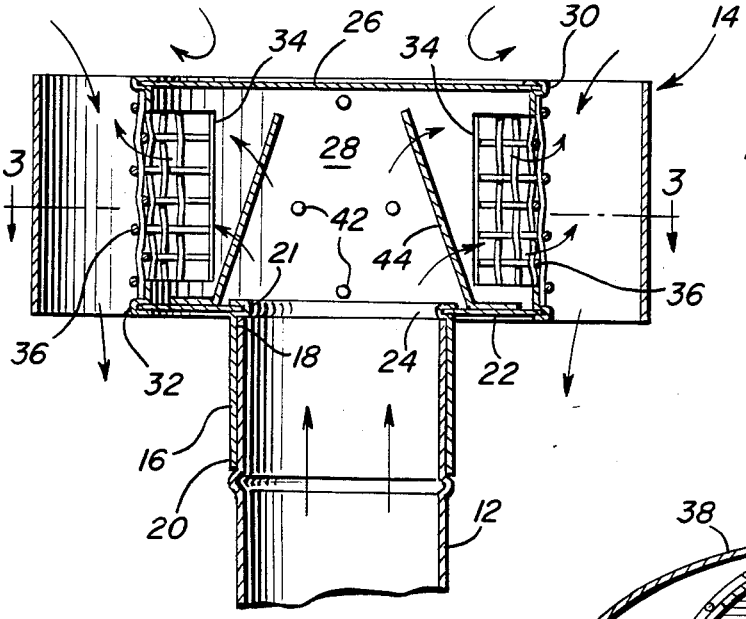
FIG. 2 is an enlarged fragmentary vertical sectional view taken substantially upon the plane indicated by the section line 2—2 of FIG. 1.

Referring now more specifically to the drawings the numeral 10 generally designates a building roof structure upwardly through which the upper outlet end of a furnace flue pipe 12 extends.

The wind cap of the instant invention is referred to in general by the reference numeral 14 and is supported from the upper end of the flue pipe 12. The wind cap 14 incorporates a cylindrical inlet nipple 16 having upper and lower ends 18 and 20 and the lower end 20 is downwardly telescoped over the upper end of the flue pipe 12. The upper end of the nipple 16 is secured through a central opening 21 formed in a circular base panel 22 by crimping 24 and a circular upper panel 26 of substantially the same diameter as the base panel 22 is spaced above the latter and supported therefrom by a cylindrical panel 28 crimped at its upper and lower ends as at 30 and 32 to the outer peripheral portions of the panels 26 and 22. The cylindrical panel 28 has diametrically opposite openings 34 formed therein and each of the openings 34 is covered by a screen panel 36.

An elliptical shield panel 38 is provided and includes a minor inside diameter substantially equal to the outside diameter of a screen panel 40 of which the panel portions 36 comprise diametrically opposite portions. The elliptical shield panel has those areas thereof defining the minor diameter portion secured to diametrically opposite portions of the cylindrical panel 28 by rivets 42 and it will be noted that the shield panel 38 is secured in position with the major diameter defining portions thereof spaced outward of the openings 34. In addition, a pair of inclined upwardly convergent baffle panels 44 have the lower marginal portions thereof supported from the base panel 32 closely inward of the openings 34 and the upper ends of the baffle panels 44 terminate a spaced distance below the top panel 26 and are spaced apart a distance equal to approximately one-half the diameter of the nipple 16.

Figure 3:
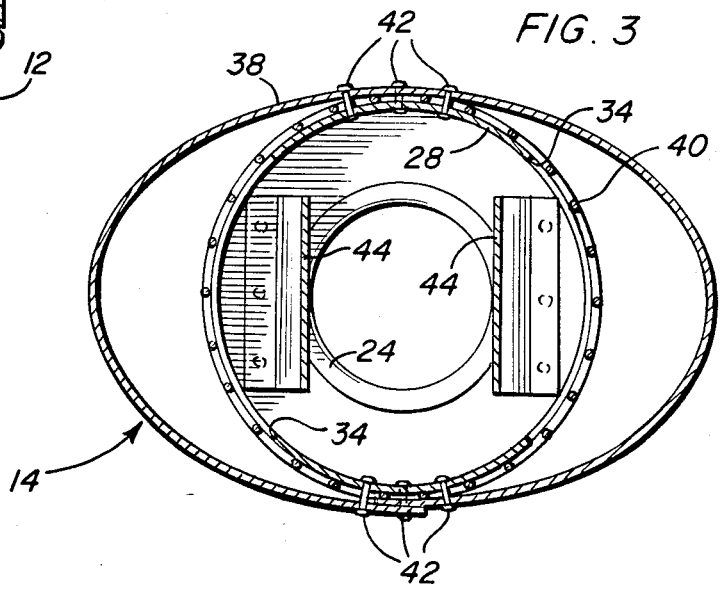
FIG. 3 is a horizontal sectional view taken substantially upon the plane indicated by the section line 3—3 of FIG. 3.

As may be seen from FIG. 3 of the drawings the shield panel 38 comprises a strip of sheet metal which has been formed into an elliptical shape and includes overlapped ends which are secured together. However, the shield panel 38 may be constructed from a short section of cylindrical tubing and deformed into the desired elliptical shape.

In operation, the flue gases from an associated furnace may pass readily upwardly through the wind cap 14 by moving upwardly between the baffle panels 44, about the latter, outwardly of the openings 34 and then upwardly and/or downwardly from the interior of the major diameter defining portions of the shield panel 38.

It is believed that it may be readily appreciated that wind incident upon the wind cap 14 from any horizontal direction as well as inclined upward and downward directions will have no adverse effect on the discharge of furnace flue gases from the wind cap 14 in a manner to develop downdrafts in the flue pipe 12. Further, it is believed quite apparent that there is a gradual reduction in the temperature of heated flue gases passing through the wind cap and, accordingly, that the discharge of heated flue gases from the wind cap will not permit an excessive buildup of ice as a result of condensation in extremely cold weather.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wind cap for the outlet end of a furnace flue pipe, said cap including a tubular inlet nipple having a first end for communicating connection with said outlet end and a second end, a base panel having a central opening formed therethrough and including two pairs of opposite outer marginal portions generally bisected by planes normal to said opening and each other and passing centrally through said opening, an upper panel of generally the same shape as said base panel and spaced thereabove, said second end opening through said opening from the side of said base panel remote from said upper panel, a tubular spacing panel extending between said base and upper panels and anchored relative thereto, a tubular shield panel of a length generally equal to the spacing between said panels and extending substantially continuously about and between said base and upper panels supporting the latter relative to each other, said tubular shield panel including major and minor transverse dimension defining portions, said tubular shield panel being telescoped over said tubular spacing panel with said minor dimension defining portions anchored relative to said tubular spacing panel and said major dimension defining portions spaced outward from diametrically opposite portions of said tubular spacing panel, said tubular spacing panel diametrically opposite portions having openings formed therein closed by screen panel portions, and a pair of inclined and upwardly convergent baffle panels interposed between said base and upper panels and having their lower marginal edge portions supported from said base panel and the upper marginal portions thereof terminating upwardly below said upper panel.

2. The wind cap of claim 1 wherein said base and top plates each include a generally circular outer periphery and said shield panel is substantially elliptical in shape.

3. The wind cap of claim 1 wherein the upper marginal portions of said baffle panels are spaced apart approximately one-half the diameter of said flue pipe.

4. The wind cap of claim 3 wherein said base and top plates each include a generally circular outer periphery and said shield panel is substantially elliptical in shape.

5. The wind cap of claim 4 wherein said screen panel portions comprise diametric opposite portions of a substantially cylindrical screen panel extending about and overlying said spacing panel, diametrically opposite portions of said screen panel being clampingly secured between opposing corresponding portions of said spacing and shield panels.

6. The wind cap of claim 5 wherein said baffle panels are generally planar.

7. The wind cap of claim 6 wherein the spacing between said base panel and said top panel is at least equal to the diameter of said nipple.

* * * * *